US005788238A

United States Patent [19]

LeBriton et al.

[11] Patent Number: 5,788,238

[45] Date of Patent: Aug. 4, 1998

[54] BOARD GAME

[76] Inventors: Michael J. LeBriton, 273 Marion St., Rochester, N.Y. 14610; Mark W. LeBriton, 59 Swan Trail, Fairport, N.Y. 14450

[21] Appl. No.: 816,405

[22] Filed: Mar. 6, 1997

[51] Int. Cl.[6] ..... A63F 1/00

[52] U.S. Cl. ..... 273/272; 273/299; 273/432

[58] Field of Search ..... 273/272, 299, 273/430, 429, 432; 434/159, 167

[56] References Cited

U.S. PATENT DOCUMENTS

| | | | |
|---|---|---|---|
| D. 270,741 | 9/1983 | Haney et al. . | |
| 2,752,158 | 6/1956 | Brunot et al. . | |
| 4,124,214 | 11/1978 | Pavis | 273/249 |
| 4,657,248 | 4/1987 | Benaim | 273/432 |
| 4,911,452 | 3/1990 | Marchese, Jr. . | |
| 4,955,614 | 9/1990 | Buda . | |
| 5,120,066 | 6/1992 | Cohen . | |
| 5,195,753 | 3/1993 | Brukl et al. . | |
| 5,207,435 | 5/1993 | Tanner . | |
| 5,261,671 | 11/1993 | Wyatt . | |
| 5,273,431 | 12/1993 | Charouhas . | |
| 5,439,232 | 8/1995 | Pollock . | |
| 5,505,456 | 4/1996 | Schmidt | 273/272 |
| 5,586,765 | 12/1996 | Lackey | 273/299 |

FOREIGN PATENT DOCUMENTS

| | | | |
|---|---|---|---|
| 2189159 | 10/1987 | United Kingdom | 273/254 |

*Primary Examiner*—William M. Pierce
*Attorney, Agent, or Firm*—Cumpston & Shaw

[57] ABSTRACT

The present invention is directed towards an educational game apparatus which requires the players to unscramble a given set of letters to form a word which matches or defines the given clue. Correct matches by a player translate into moves for the player's pieces around a game board and results in the eventual achievement of the game board objectives. The object of the game is for a player to mark off all the letters, numerals or other appropriate indicia on his/her score card, i.e.: a laminated strip in the shape of a bacon strip, by moving his/her game piece in either direction around the game board. The winner of the game is the first individual or team to completely mark off all the letters, numerals or other appropriate indicia on their score cards.

21 Claims, 6 Drawing Sheets

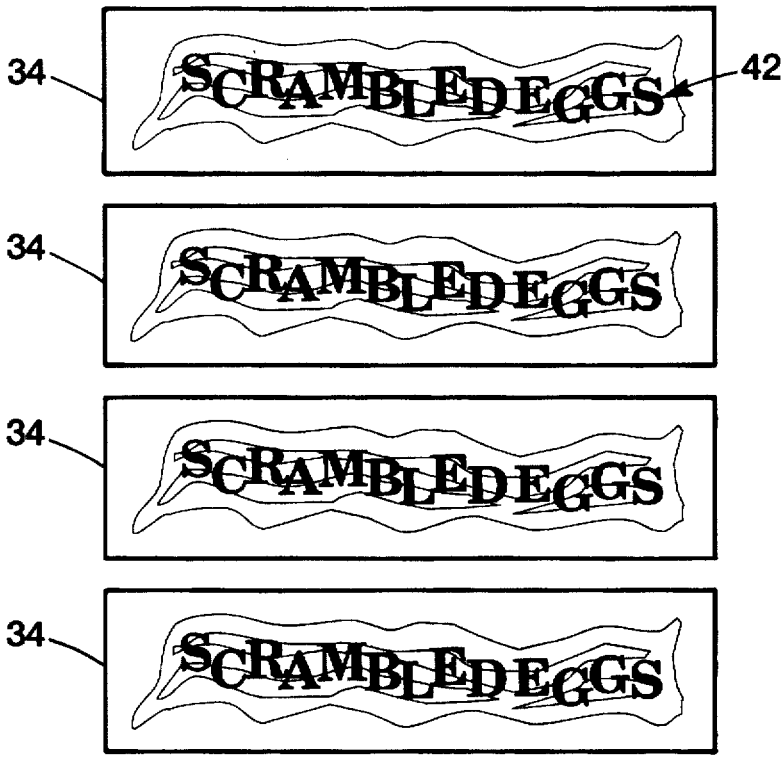

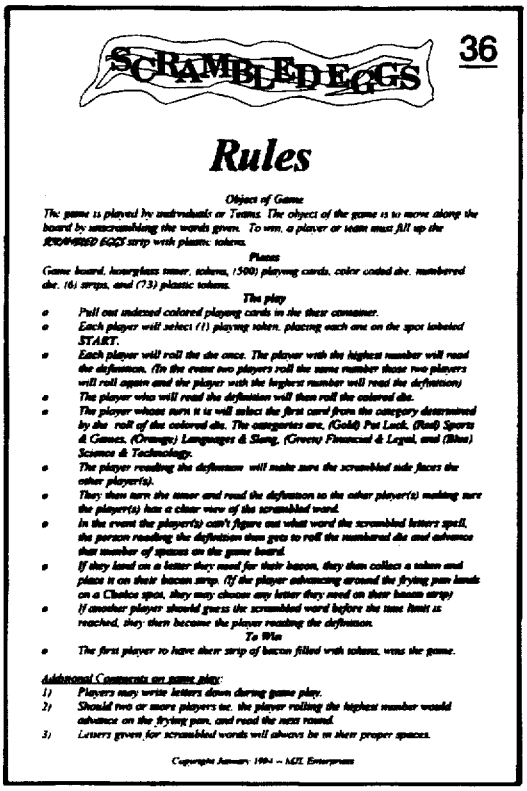

SCRAMBLEDEGGS 36

Rules

*Object of Game*

*The game is played by individuals or Teams. The object of the game is to move along the board by unscrambling the words given. To win, a player or team must fill up the SCRAMBLED EGGS strip with plastic tokens.*

*Pieces*

*Game board, hourglass timer, tokens, (500) playing cards, color coded die, numbered die, (6) strips, and (73) plastic tokens.*

*The play*

- *Pull out indexed colored playing cards in the their container.*
- *Each player will select (1) playing token, placing each one on the spot labeled START.*
- *Each player will roll the die once. The player with the highest number will read the definition. (In the event two players roll the same number those two players will roll again and the player with the highest number will read the definition)*
- *The player who will read the definition will then roll the colored die.*
- *The player whose turn it is will select the first card from the category determined by the roll of the colored die. The categories are, (Gold) Pot Luck, (Red) Sports & Games, (Orange) Languages & Slang, (Green) Financial & Legal, and (Blue) Science & Technology.*
- *The player reading the definition will make sure the scrambled side faces the other player(s).*
- *They then turn the timer and read the definition to the other player(s) making sure the player(s) has a clear view of the scrambled word.*
- *In the event the player(s) can't figure out what word the scrambled letters spell, the person reading the definition then gets to roll the numbered die and advance that number of spaces on the game board.*
- *If they land on a letter they need for their bacon, they then collect a token and place it on their bacon strip. (If the player advancing around the frying pan lands on a Choice spot, they may choose any letter they need on their bacon strip)*
- *If another player should guess the scrambled word before the time limit is reached, they then become the player reading the definition.*

*To Win*

- *The first player to have their strip of bacon filled with tokens, wins the game.*

*Additional Comments on game play:*

1) *Players may write letters down during game play.*
2) *Should two or more players tie, the player rolling the highest number would advance on the frying pan, and read the next round.*
3) *Letters given for scrambled words will always be in their proper spaces.*

*Copyright January 1994 — MZL Enterprises*

FIG. 7

BOARD GAME

FIELD OF THE INVENTION

The present invention is directed towards an educational game apparatus which requires the players to unscramble a given set of letters to form a word which matches or defines the given clue. Correct matches by a player translate into moves for the player's pieces around a game board and results in the eventual achievement of the game board objectives.

BACKGROUND OF THE INVENTION

Game apparatus utilizing board games or card decks are commonly found in patent applications and on store shelves. Wile the prior art teaches game boards and card decks designed to stimulate the mental faculties of the players, it does not teach the combination of both, whereby the cards exercise and expand the player's knowledge of a particular subject area and the movement of playing pieces on the game board.

Various configurations of game boards have been patented for the designs. U.S. Des. Pat. No. 41,844 to Cooke describes a game board with spokes radiating from a center circle, where the spokes intersect two additional rings of circles of larger diameter concentric to the center circle, and whereby spaces are located at these intersections. U.S. Des. Pat. No. 223,846 to Richard Smith similarly describes the design of the game board comprising a plurality of line connected circles which outline a hexagon. U.S. Des. Pat. No. 57,982 to Loring depicts a game board design laid out in rectangular areas, so connected as to depict a pathway for moving game pieces.

Other adult oriented games which relate more to "word" solving as opposed to "question" solving, are OUTBURST!® sold by Hersch & Company and HUGGERMUGGER® sold by the Huggermugger Company. In playing OUTBURST!®, each team must shout out words which are elements of a category given to them by the opposing team. The opposing team holds a list with the correct words which are checked off as the playing team names them.

In playing HUGGERMUGGER®, a "mystery/word" must be solved with one letter of the mystery word being revealed to a player each time that player correctly answers a question given from one of four different categories. The first to solve the mystery word wins the game.

Further, there are a great variety of board games which are played for amusement and social purposes. However, few such games have any educational value. It is generally recognized that the linguistic ability of most adults is relatively low. It is also well known that success and business in other walks of life to a great extent depends upon a person's ability to effectively communicate with others and to clearly express ideas. In order to do so, it is necessary to have a relatively large vocabulary of English words and phrases and a knowledge of their proper application. Moreover, it is necessary to correctly spell those words and phrases.

In view of the above, there is a need for a linguistic game which will not only entertain but will also educate the players thereof in the correct spelling and usage of various English words and phrases and will improve their overall linguistic ability. Such a game should be simple, fascinating, inexpensive and easy to play, and should be capable of accommodating a number of players.

SUMMARY OF THE INVENTION

The educational board game and method of playing the game forming the present invention satisfy all the foregoing needs. The present invention comprises a card having two surfaces, a front surface that reveals a set of scrambled letters which correspond to a valid word or set of words, and a back surface that indicates the definition, clue and/or solution of the scrambled letters located on the front surface. Preferably, the front surface of the card includes a series of scrambled letters and an appropriate number of spaces with a predetermined number of letters inserted into their correct spaces.

In a further embodiment, the present invention is a method of playing a board game with a plurality of players, comprising: providing the following board game equipment: a game board having a plurality of distinguishable spaces creating a continuous path; a plurality of playing pieces, each piece being distinct; a plurality of decks of playing cards, each of said decks being distinguishable by a unique indicia or color, each card within each of said decks having two surfaces, a front surface that reveals a set of scrambled letters which correspond to a valid word or set of words, and a back surface that indicates the definition, clue and/or solution of the scrambled letters located on the front surface; a timing device to limit the period in which any player must complete a turn at play; at least one color coded instrument; at least one numbered die; a plurality of score cards; and a set of instructions for determining the sequence and rules of play; assigning each player a set of the playing pieces; determining the sequence for players to play the board game by having the players roll a numbered die, the highest number rolled initiating the sequence; manipulating the colored coded instrument to determine the category of play at each turn; having players attempt to answer a scrambled word question from a playing card from the selected category for each turn; upon correctly answering the word question, allowing players to advance along the game board in accordance with the aforesaid instructions, and to so move such pieces; and repeating turns until one player or team of players has achieved a completed game in accordance with the aforesaid instructions.

BRIEF DESCRIPTION OF THE DRAWINGS

FIG. 7 illustrates a plurality of score cards;

DETAILED DESCRIPTION OF THE INVENTION

Figure 1:
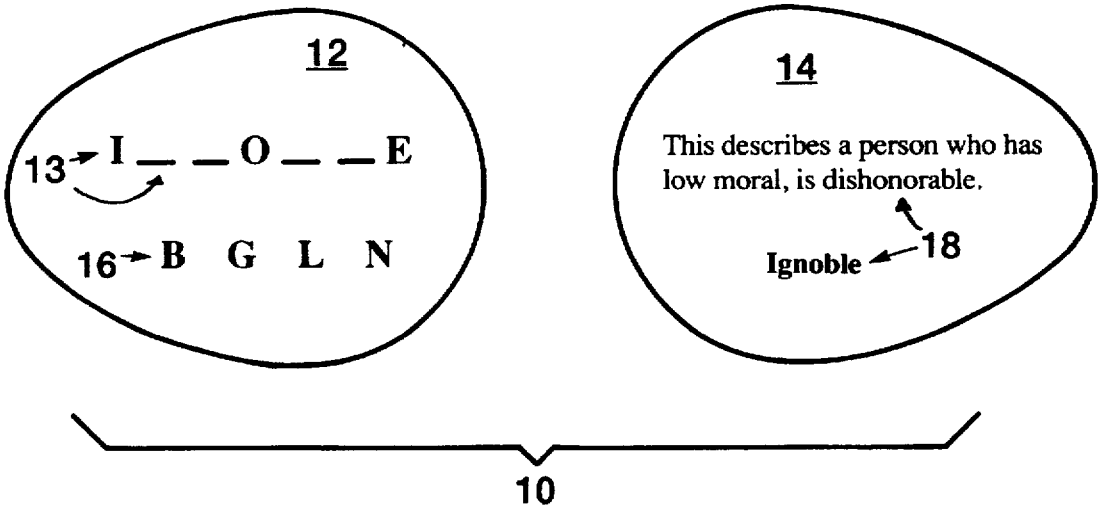
FIG. 1 illustrates the front and back surfaces of the clue cards according to the invention.

Referring to the drawings, as seen in FIG. 1, a representative clue card designated generally by the numeral 10, a surface of which is considered the front surface of the card being labeled with reference numeral 12 and the opposite or back surface being labeled with reference numeral 14. Front surface 12 has a set of scrambled letters 16 which correspond to a valid word, preferably a word found in the English language. However, the letters may correspond to any foreign language depending upon the linguistic abilities of the players. Further, spaces 13 may be present on the front surface to indicate a specific position for an appropriate letter.

Figure 9:
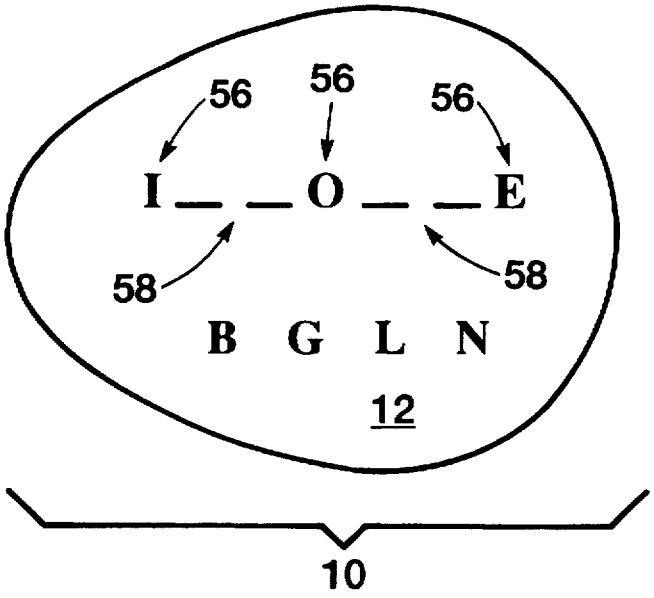
FIG. 9 illustrates a clue card having letters placed in their correct sequence in a word or series of words.

In an alternative embodiment shown in FIG. 9, to aid the players in solving the scrambled word, certain predetermined letters or indicia 56 may be correctly inserted in its proper location within a plurality of spaces 58 which correspond to a solved word on the front surface 12 of the card 10. Preferably, the front surface of the card includes a series of scrambled letters and an appropriate number of spaces with a predetermined number of letters inserted into their correct spaces.

The back surface 14 of card 10 has the definition, clue and/or solution 18 of the scrambled letters 16 on the front surface 12 imprinted thereon. Briefly, playing the game involves players solving as many of the scrambled letters 16 as possible to correctly spell a word within a predetermined period of time to accumulate points. The scrambled letters 16 make up a word which is defined by the clue, definition, or solution 18 on the back surface 14 of the card 10.

Figure 2:
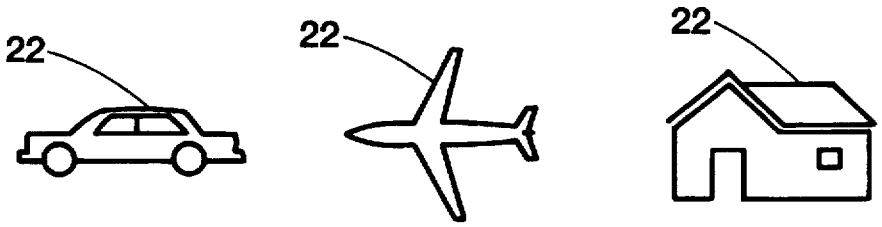
FIG. 2 illustrates the playing pieces.
Figure 3:
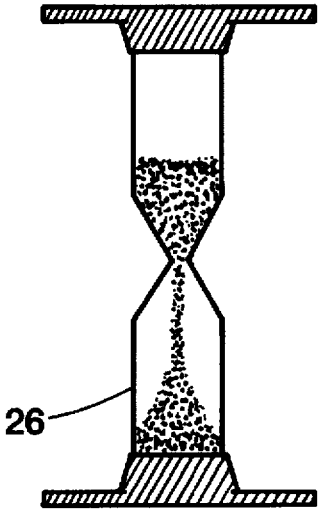
FIG. 3 illustrates a timing device.
Figure 4:
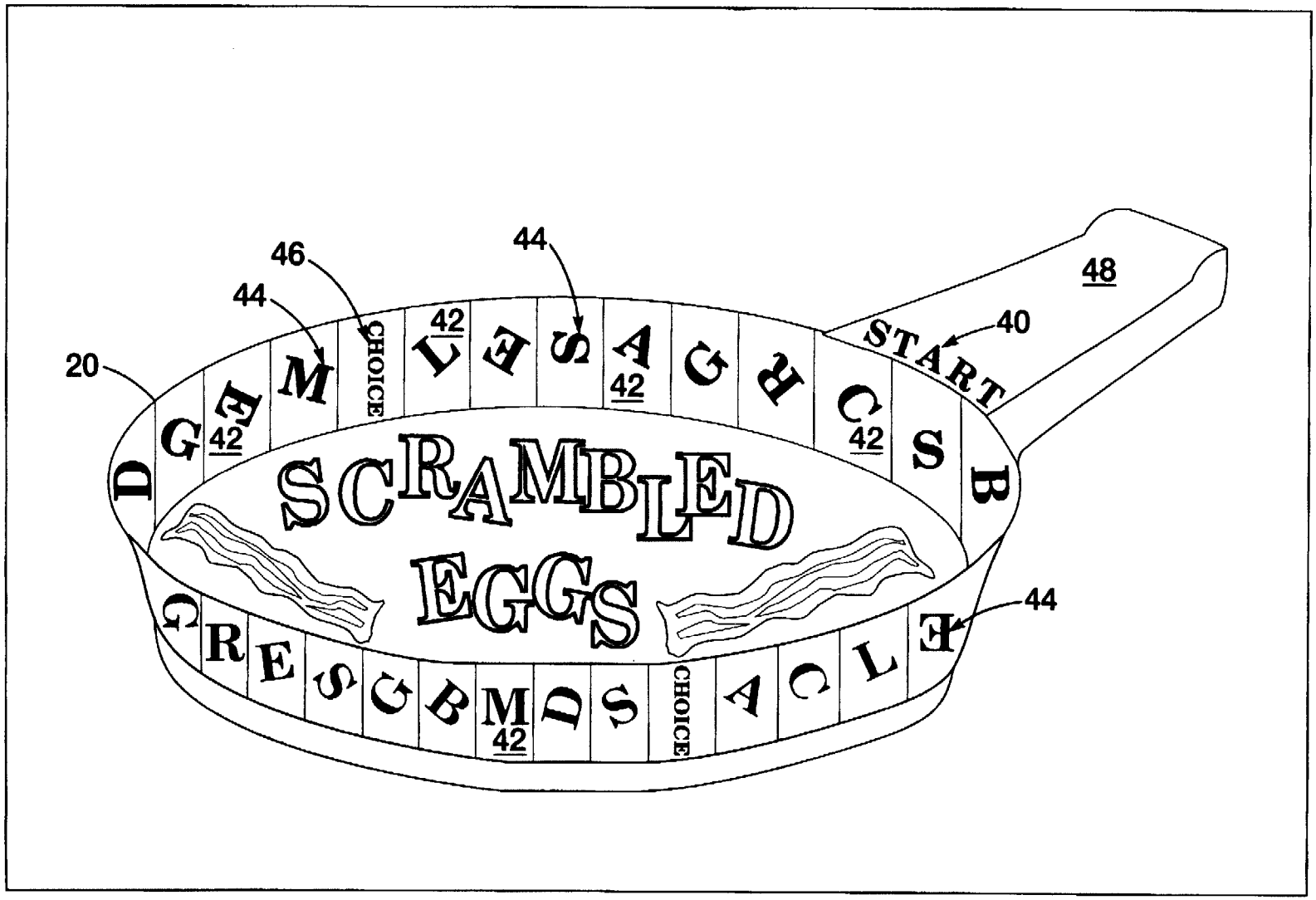
FIG. 4 illustrates the game board.
Figure 10:
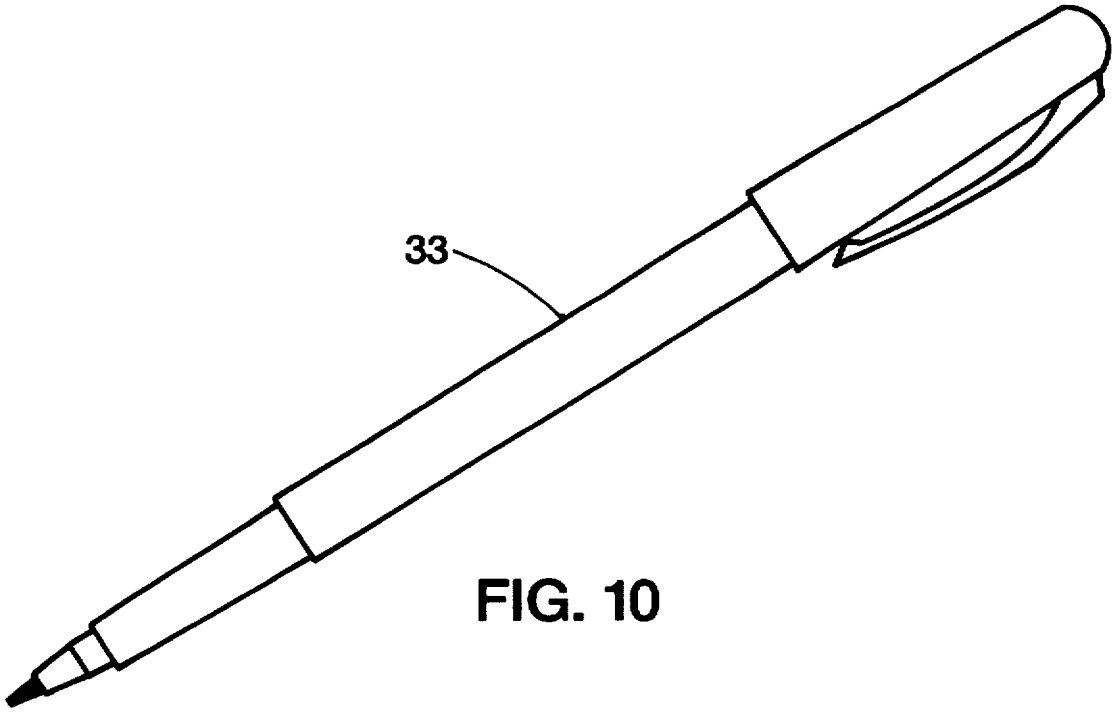
FIG. 10 illustrates a set of instructions and a marking utensil.

As shown in FIGS. 2 and 4, the game includes a game board 20 having a plurality of distinguishable spaces 42 creating a continuous path and a plurality of playing pieces 22, each of the playing pieces 22 being distinct. Further, a plurality of decks 50 of playing cards 24, each of said decks 50 being distinguishable by a unique indicia or color, each card 24 within each of the decks 50 having two sides, a front surface 12 and a back surface 14 (see FIG. 5). The decks of cards are arranged in card holders 28. As illustrated in FIG. 3, a timing device 26, such as a clock, a stopwatch, an hourglass or other appropriate timing device is included to limit the period in which any player must complete a turn at play. As shown in FIG. 6, at least one color coded playing instrument, such as a color coded die, 32 is included to determine which categories are to be played. Alternatively, a spinner 35 may be employed to determine the categories. At least one numbered die 30 is included to determine the number of spaces 42 to be advanced along the game board 20. A plurality of score cards 34, a marking utensil 33, such as a pencil or felt tip pen, and a set of instructions 36 for determining the sequence and rules of play are further included to complete the game package (see FIGS. 7 and 10).

The object of the game is for a player to mark off all the letters, numerals or other appropriate indicia 42 on his/her score card 34, preferably a laminated strip 34 in the shape of a bacon strip (see FIG. 7), by moving his/her game token or piece 22 (as shown in FIG. 2) in either direction around the game board 20 (see FIG. 4). Preferably, the board game includes two sets of corresponding letters, numerals or indicia 42. In the present invention, the board game has two sets of corresponding letters which spell "SCRAMBLED EGGS". As shown in FIG. 7, the score card 34 includes the same number of one set of corresponding letters, numerals, or other appropriate indicia 42 as the game board 20. When a player lands on a letter 42 on the game board 20, the player marks the corresponding letter or space 42 on the player's score card or laminated strip 34. The winner of the game is the first individual or team to completely mark off all the letters, numerals or other appropriate indicia 42 on their score cards 34.

Discussion now turns to the rules and manner of playing the game. It is to be understood that the following example of the game being played on a game board 20 having a frying pan with the scrambled letters "SCRAMBLED EGGS" as its pattern is for illustrative purposes only and is not a limitation of the invention. Many different designs, letters, and words may be employed to execute the described invention.

Preferably, the game board 20 has a frying pan as its pattern with scrambled letters 44, which when spelled correctly, spell "SCRAMBLED EGGS" (see FIG. 4). Each letter 44 of the scrambled word comprises its own space 42 on the game board 20. Preferably, there are enough spaces 42 with letters 44 on the game board 20 to spell the desired word twice. This allows for a larger playing surface. Two spaces 46 are dedicated to a "CHOICE" marking, the significance of which will be fully explained later.

Players divide into evenly numbered teams with a proposed maximum number of teams being six. Each player or team will select a playing token 22, placing each token 22 on the spot labeled START 40 on the game board 20, preferably on the panhandle 48 (See FIGS. 2 and 4). Each player will roll a numbered die 30, shown in FIG. 6, once. Still referring to FIG. 6, the player with the highest number becomes the reading player and will then roll the colored die 32. The colors imprinted on the die correspond to the colors attributed to the different categories of topics played in the game. Preferably, there are six colors, six sides to the die, and five categories with a total of 500 playing cards. The reading player will select any card from the category determined by the roll of the colored die 32. Preferably, the colors corresponding to categories are: gold for Pot Luck; red for Sports & Games; orange for Slang & Languages; green for Financial & Legal; and blue for Science & Technology. Preferably, if the white side is rolled or spun, the reading player may choose any category.

Figure 5:
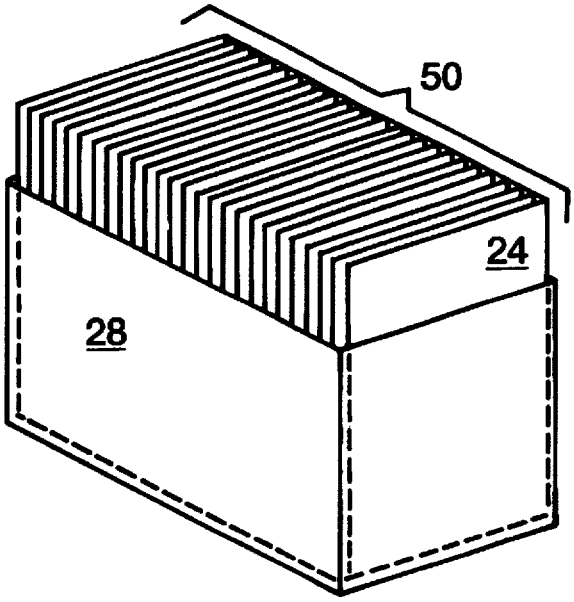
FIG. 5 illustrates a deck of clue cards in a holder.
Figure 6:
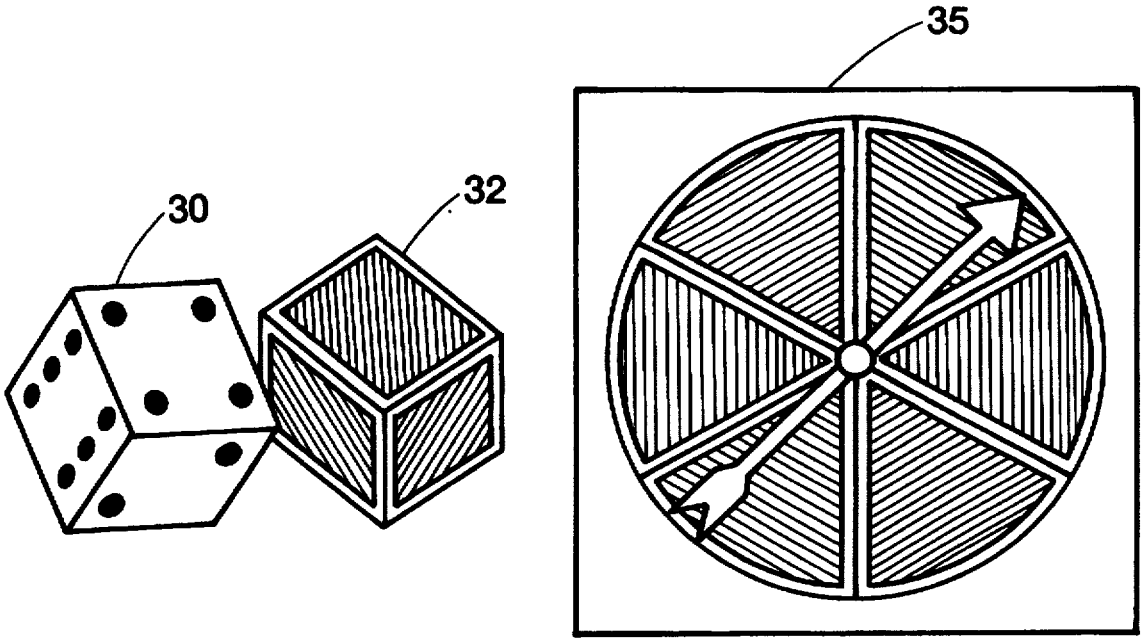
FIG. 6 illustrates a numbered dice and a colored dice.

Referring to FIG. 5, the reading player or team draws a clue card 24 from a deck of clue cards 50 from a distinct category placed in a card holder 28, the holder exposing only a small portion of the top ends of the deck 50 to effectively hide the printed material on the clue cards 24 within the holder 28 until they are removed therefrom. As previously explained, each clue card 24 has a different set of scrambled letters 16 on the front surface 12 and the definition or clue 18 on the back surface 14 of the card 10. The reading player will make sure the scrambled letters 16 on the front surface 12 face the other player(s) or team(s). The reading player will read the definition or clue 18, start the timing device 26 (as shown in FIG. 3), and display the scrambled letters 16 printed on the front surface 12 of the card 10 to all players. The first player or team to solve the scrambled letters 16 to form a word 18 before the time limit has expired wins the right to roll the numbered die 30 (shown in FIG. 6). Upon rolling the numbered die 30, the player moves his/her game piece in either direction along the game board 20 the same number of spaces as displayed on the numbered die 30 (see FIGS. 4 and 6). In the event two or more players correctly answer simultaneously, the players will roll the numbered die 30, and the highest number will advance on the game board 20.

If the player lands on a letter needed to fill in the player's score card 34 or laminated strip 34, the player marks that letter on his/her card 34 (see FIG. 7). Referring to FIGS. 4 and 7, preferably, if a player lands on an S, E or G, the player can mark off both of those letters on their score card 34. If the player lands on a letter CHOICE space 46, the player may mark off any desired space or letter 42 on their score card 34. Generally, if the letter appears more than once on the score card 34 and the game board 20, the player may mark off the letter as many times as it appears.

A player becomes the reading player after guessing the correct word. The reading player will roll the colored die 32 and repeat the process until another player solves the scrambled word 16.

In the event the player(s) or team(s) cannot solve the scrambled word 16 within the predetermined time limit, the reading player rolls the numbered die 30 again and advances his/her game piece 22 along the game board 20 the same number of spaces as indicated on the numbered die 30.

Figure 8:
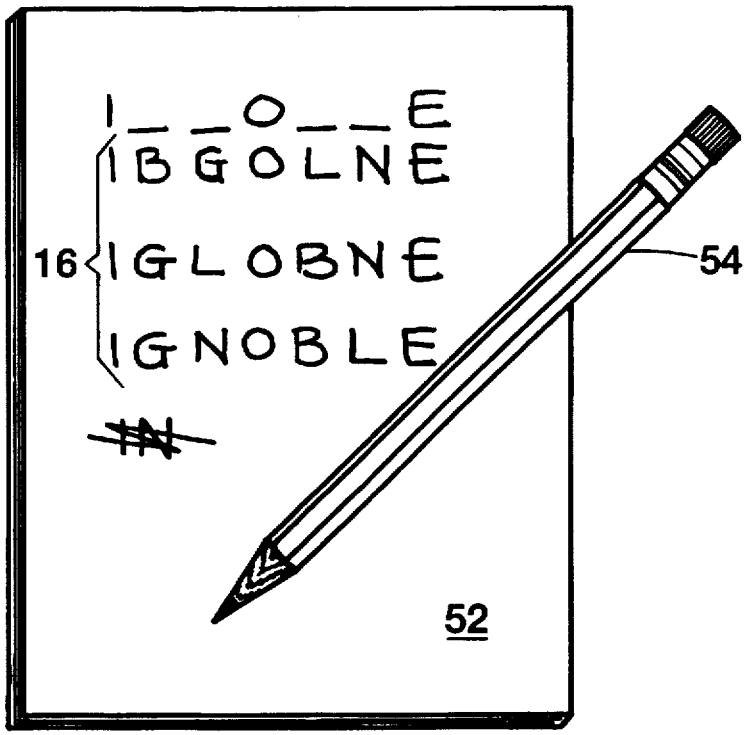
FIG. 8 illustrates a pad of paper and a writing utensil.

As shown in FIG. 8, players may write the scrambled letters 16 on paper 52 with a pen or pencil 54 during the game to help the player solve the correct answer, if the player so chooses.

Additional card packs for different levels of difficulty and/or subject matter may be included with the board game or sold separately. Multiple versions of the game for educational purposes are also envisioned, as is a possible video version. Variations as to the size, shape and design of the score cards along with disposable writing pads and laminated strips are envisioned and may be sold separately.

Numerous modifications and variations of the present invention are possible in view of the aforedescribed disclosure. Therefore, the foregoing is considered as illustrative only of the principles of the invention and not as a limitation of the invention to the exact constuction and operation shown and described. Accordingly, all suitable modifications and equivalents may be resorted to, falling within the scope of the invention.

I claim:

1. A method of playing a board game with a plurality of players, comprising:

(a) providing the following board game equipment:

(i) a game board having a plurality of distinguishable spaces creating a continuous path;

(ii) at least one letter located on each of the plurality of distinguishable spaces;

(iii) a plurality of playing pieces, each playing piece being distinct;

(iv) a plurality of decks of playing cards, each of said decks being distinguishable by a unique indicia or color, each card within each of said decks having two surfaces, a front surface that reveals a set of scrambled letters which correspond to a valid word or set of words, and a back surface that indicates the definition, clue or solution of the scrambled letters located on the front surface;

(v) a timing device to limit the period in which any player must complete a turn at play;

(vi) at least one color coded instrument;

(vii) at least one numbered dice;

(viii) a plurality of score cards;

(ix) the plurality of score cards having letters imprinted thereon;

(x) a set of instructions for determining the sequence and rules of play;

(xi) a marking utensil;

(b) assigning each player a playing piece;

(c) determining the sequence for players to play the board game by having the players roll a numbered die, the highest number rolled initiating the sequence;

(d) rolling the colored dice to determine the category of play at each turn;

(e) having players attempt to answer a scrambled word question from a playing card from the selected category for each turn;

(f) upon correctly answering the word question, allowing players to advance along the game board in accordance with the aforesaid instructions, and to so move such pieces;

(g) moving the pieces and landing on a letter on the game board which corresponds to a letter on the score card, the player marking, with the marking utensil, the letter on his/her score card; and (h) repeating turns until one player or team of players has achieved a completed game in accordance with the aforesaid instructions.

2. The method of playing a board game as defined in claim 1 in which the game board includes a design of a frying pan with the letters "SCRAMBLED EGGS" printed thereon.

3. The method of playing a board game as defined in claim 1 in which each playing piece is a distinct design.

4. The method of playing a board game as defined in claim 1 in which certain predetermined letters or indicia may be correctly marked with the marking utensil in its proper location within a plurality of spaces which correspond to a solved word on the front surface of the card.

5. The method of playing a board game as defined in claim 1 in which the timing device is an hourglass.

6. The method of playing a board game as defined in claim 1 in which the plurality of score cards are strips of material having the same number of distinguishable spaces as the corresponding game board.

7. The method of playing a board game as defined in claim 1 in which the letters on the plurality of score cards may be arranged to spell "SCRAMBLED EGGS".

8. The method of playing a board game as defined in claim 1 in which the score cards are laminated with a plastic substrate.

9. The method of playing a board game as defined in claim 1 in which the player who rolls the highest number on the numbered dice at the start of the game becomes a first reading player.

10. The method of playing a board game as defined in claim 9 in which the reading player rolls the colored dice to determine the particular category of play.

11. The method of playing a board game as defined in claim 10 in which the reading player selects an appropriate card from the selected category and reads a definition, clue, or solution and displays the scrambled letters to the remaining players or teams.

12. The method of playing a board game as defined in claim 1 in which the first player or team to solve the scrambled letters to form a word before a predetermined time limit has expired wins a right to roll the numbered dice.

13. The method of playing a board game as defined in claim 1 in which the player moves his/her game piece in either direction along the game board the same number of spaces as displayed on the numbered dice.

14. The method of playing a board game as defined in claim 1 in which if a letter appears more than once on the score card and the game board, the player may mark off the letter as many times as it appears on the score card.

15. The method of playing a board game as defined in claim 1 in which the player who correctly guesses the scrambled word becomes the reading player.

16. The method of playing a board game as defined in claim 1 in which the color coded instrument is a color coded die.

17. The method of playing a board game as defined in claim 16 in which the reading player will roll the colored dice and repeat the steps as defined in claims 2–19 until another player solves the scrambled word.

18. The method of playing a board game as defined in claim 12 in which if the scrambled word is not solved within a predetermined time limit, the reading player rolls the numbered die again and advances his/her game piece along the game board the same number of spaces as indicated on the numbered dice.

19. The method as defined in claim 1 in which the front surface of the card includes a series of scrambled letters and an appropriate number of spaces with a predetermined number of letters which may be marked with the marking utensil into their correct spaces.

20. A method of playing a board game as defined in claim 1 in which the board game includes a CHOICE space.

21. The method of playing a board game as defined in claim 20 in which if the player lands on the CHOICE space on the game board, the player may mark off any desired letter on the score card.

* * * * *